United States Patent [19]

van den Hoogen

[11] Patent Number: 5,005,760

[45] Date of Patent: Apr. 9, 1991

[54] FLEXIBLE PLIABLE RETAINING PACKAGE FOR FLOWERS AND PLANTS

[76] Inventor: Lambertus A. M. van den Hoogen, 3, Antoniusstraat, NL-5408 AM Volkel, Netherlands

[21] Appl. No.: 221,785

[22] PCT Filed: Aug. 31, 1987

[86] PCT No.: PCT/EP87/00491

§ 371 Date: Apr. 28, 1988

§ 102(e) Date: Apr. 28, 1988

[87] PCT Pub. No.: WO88/01593

PCT Pub. Date: Mar. 10, 1988

[30] Foreign Application Priority Data

Sep. 2, 1986 [NL] Netherlands ..... 8602213

[51] Int. Cl.[5] ..... B65D 5/24

[52] U.S. Cl. ..... 229/125.38; 206/423; 229/189; 229/910; 493/59; 493/121

[58] Field of Search ..... 383/4, 72, 120; 229/50, 229/189, 910, DIG. 3, 3.1, 3.5 MF, 125.38; 206/423; 47/73, 74, 76, 77, 84; 493/59-61, 63, 121, 148

[56] References Cited

U.S. PATENT DOCUMENTS

| | | | |
|---|---|---|---|
| D. 117,833 | 11/1939 | Laine | 229/189 |
| 396,570 | 1/1889 | Hotchkiss | 229/50 |
| 1,342,432 | 6/1920 | Eaton | 383/120 |
| 1,439,426 | 12/1922 | Lemke | 47/74 |
| 1,464,534 | 8/1923 | Lovett, Jr. | 206/423 |
| 1,467,690 | 9/1923 | Schwarz | 229/189 |
| 1,909,127 | 5/1933 | Satterthwaite | 383/120 |
| 1,994,553 | 3/1935 | Wolcott | 206/423 |
| 2,831,624 | 4/1958 | Lever | 383/4 |
| 3,097,782 | 7/1963 | Koropatkin et al. | 229/189 |
| 3,140,196 | 7/1964 | Lacy et al. | 229/3.5 MF |
| 4,043,077 | 8/1977 | Stonehocker | 206/423 |

FOREIGN PATENT DOCUMENTS

| | | | |
|---|---|---|---|
| 901179 | 7/1945 | France | 229/910 |
| 530989 | 12/1940 | United Kingdom . | |
| 943614 | 12/1963 | United Kingdom . | |

OTHER PUBLICATIONS

"The Plastics Manual", by A. E. Lever, 1966, pp. 55-62.

"Distribution Packaging" by Friedman & Kipnees, 1977, p. 342.

"Fibre Box Association Handbook", 1974, p. 4.

*Primary Examiner*—Gary E. Elkins

*Attorney, Agent, or Firm*—Horst M. Kasper

[57] ABSTRACT

A containing package of cardboard for flowers and plants and the method for manufacturing such a package, said package being pliable in such a manner that the flowers and plants can be forwarded safely in it and can be displayed at delivery in this package in its partly fold-out position, which functions as a vase or as a flower-pot, having a bottom (1), side planes (2) and connecting flaps (3).

15 Claims, 2 Drawing Sheets

FIG. 1
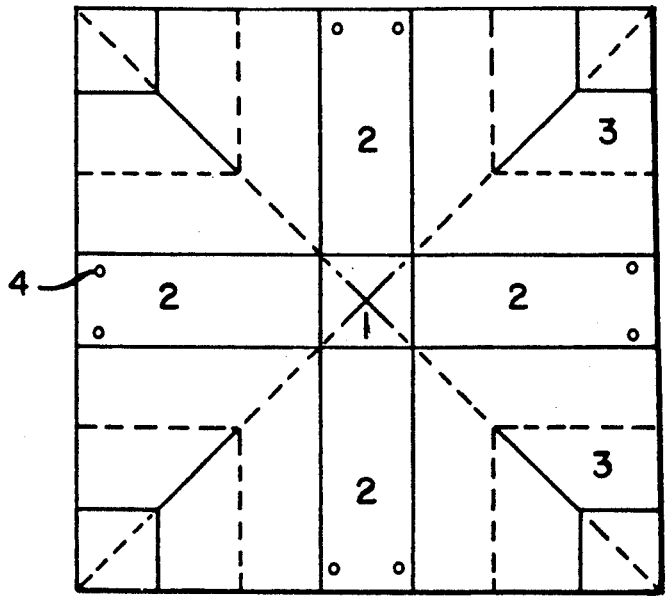
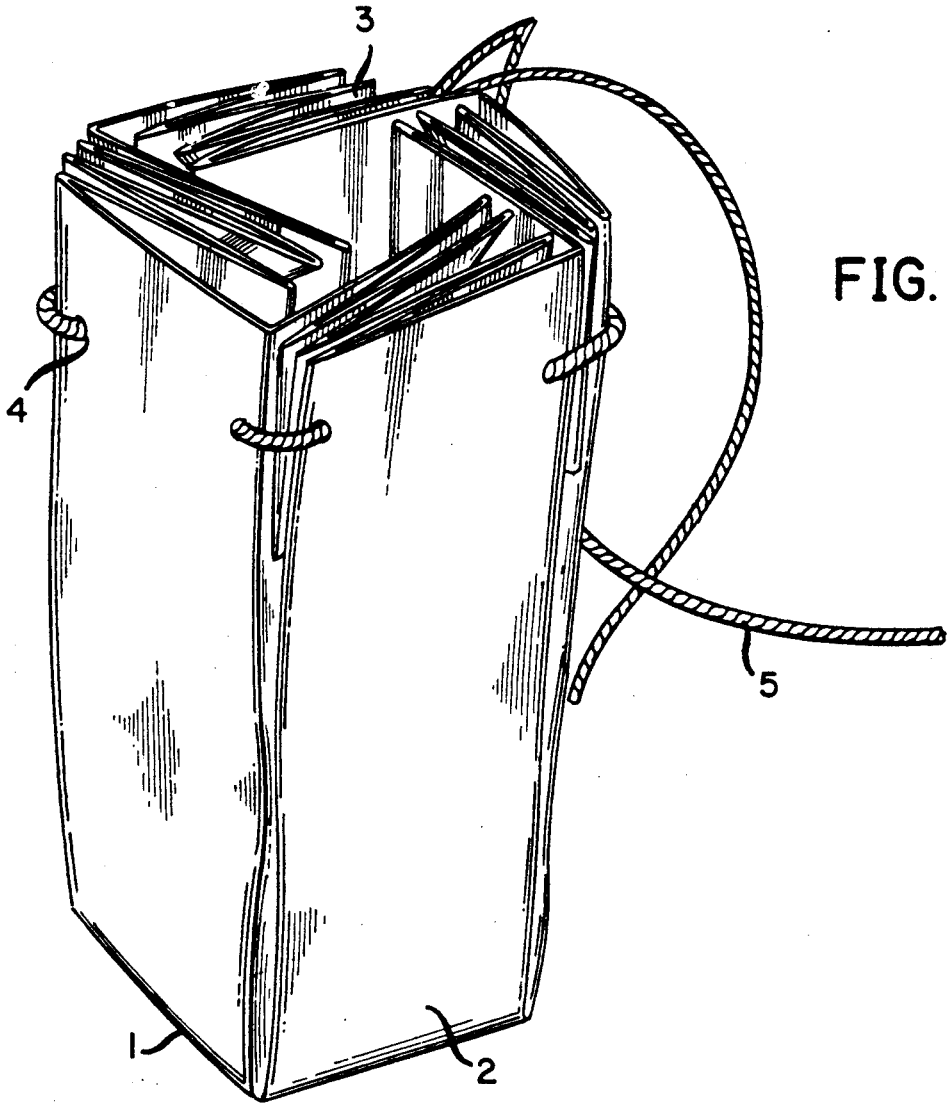
FIG. 2

FLEXIBLE PLIABLE RETAINING PACKAGE FOR FLOWERS AND PLANTS

CROSS-REFERENCE TO RELATED APPLICATIONS

This application is a continuation-in-part application of another international application filed Aug. 31, 1987 under the Patent Cooperation Treaty and bearing application No. PCT/EP87/00491. The entire disclosure of this application, including the drawings thereof, is hereby incorporated in this application as if fully set forth herein.

The present invention is related to a flexible pliable retaining package for flowers and plants, which can be used as a packing for carrying or as a vase or flower-pot, while water for keeping said flowers or plants fresh and, if so desired, moist vegetable cultivation earth or moss for fixed plants can be put into it.

For the packing and forwarding of cut flowers, e.g. as air freight, rectangular board boxes are already known, which have several openings in the side walls.

In order to keep cut flowers fresh and in good condition, cases have been suggested, which might retain water.

Such a case has been described in Journal "Adformatie" nr. 24, page 131, of Jun. 12, 1986.

These referred cases for the transport of cut flowers consist of an open rectangular water box of water-resistant impregnated corrugated cardboard and a lid or cover box, which is rectangular as well and which is put over the water-resistant box and provided with blanked levers. Such a box provides a good protection of the vulnerable product during forwarding, however it cannot be fold up, and it is not suited and not appropriate to serve as a vase or as a flower-pot for domestic use as well.

It is well-known, that on celebrations, festive occasions, jubilees etc., many bouquets and flowers and plants are delivered, while it becomes often apparent, that there is no sufficient number of pots, baskets, vases or containers for same available.

This occurs also many times in hospitals and in hotels.

A package or container, which could be stored in folded up form, is easier to keep in stock and can be used for several purposes.

For similar cases it would be vary advantageous for the customer if a kind of package could be delivered, which can be transformed into a vase of esthetically acceptable shape.

Such a container can be printed with a logo or slogan, which renders a significant character to the article.

The article according to the present invention is a container made of a plano of flat coated card-board.

The size, adapted to the size of the cut flowers or of the bouquet, can be fold out and is kept in its partly or more or less fold-out shape, as desired, by means of a string, which extends around the upper part and which surrounds the side parts, and the ends of said string are then tied together.

In this way the article forms a vase-like container, which is open at its top side.

Upon the bottom some water or vegetable earth or a moss mould or a holding means for the stalks of flowers can be put.

The packaging container is made according to the present invention by folding a quadrangular plano or flat sheet of waterproof-coated or plastic-lined card-board along creased folding lines. Said folding lines are in cross-form and diagonal, such that four side planes, standing up to a variable degree around a square bottom surface are formed. Said side planes are connected to each other by inwardly folded flaps, creating in the middle an almost quadrangular empty space. The height of the container conforms to the height of the side planes. Said side planes are provided with perforated small holes near to the edge in their upper part. A string is pulled through said small holes, to the effect that said container is kept entirely collapsible or folded outwardly in the desired position be said string, which is put around said planes and kept at its place through said holes.

By adjusting the tightness of the string, the container can be more or less folded and can therefore, in a less tightly folded position, acquire the shape of an open vase An amount of water or of moist earth or moss can be poured into the container, because the card board material is impermeably coated and the side planes are connected with each other by flaps, which are waterproof as well.

The card-board may be flexible packaging card-board such as pliable card-board, Bristol Board or kraft-lined coated corrugated board A structural cardboard in the context of the present invention is a foldable cardboard or corrugated cardboard. Pliable cardboard coated with polypropylene is very suitable for this purpose, but other coated types of cardboard and of flexible plastic can also be used, such as e.g. cardboard coated on one side with polyethylene or polypropylene and on the other side with aluminum foil. A water resistant cardboard in the context of the present invention is a waterproof coated or plastic lined cardboard.

For the transport a plastic bag can be put over the upper side or over the entire container.

The string can be paper-rope or canvass or rubber or a plastic rope.

The invention is further elucidated with reference to the annexed FIGS. 1, 2 and 3.

FIG. 1 shows the flat plano of cardboard with the creased folding lines.

FIG. 2 shows the container in its folded-in position.

Figure 3:
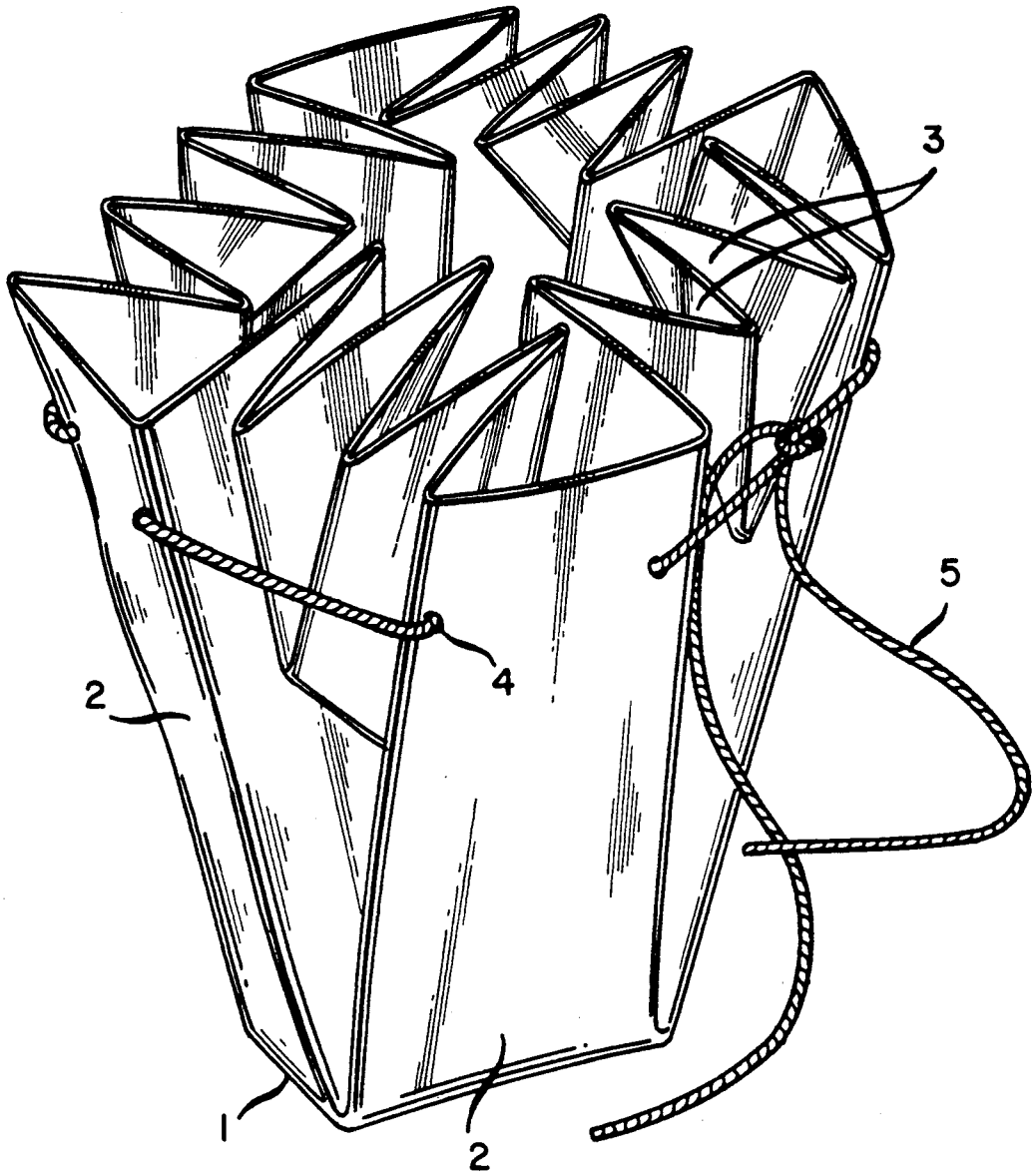
FIG. 3 shows an aspect in partly folded-out position as a vase for flowers.

In the lower part of the folded container, there can be placed water and/or earth, and/or moss, and a fixing device where the flower stalks can be inserted and held in place. A support in the context of the present invention is a holding means, moss or earth.

In the FIGS. (1) is the square bottom plane, (2) are the four side-planes to be folded upwards, (3) are the connecting flaps to be fold inwards, which form the pliable connection between said side planes (2), and (4) are the small perforated holes in the said side planes (2) near to the edges of same, for the string (5), which is put around the said side planes (2) and around the connecting flaps (3).

This kind of packaging device is envisaged to become of considerable importance for cultivators, importers and exporters of flowers, bouquets and bulb plants.

I claim:

1. A packaging container for transport and display of flowers and plants, constructed for retaining water for keeping the flowers and plants fresh and for adding if desired a support characterized in that said container is made of a quadrangular sheet of waterresistant cardboard folded along creased folding lines, which are in crossform and diagonal over a surface of the sheet, such that four side planes (2), standing up to a variable degree around a square bottom surface (1) are formed, said side planes (2) being connected to each other by inwardly fold flaps (3), creating in a middle of said planes an almost quadrangular empty space having a height adapted to a height of the side planes (2), while said side planes (2) are provided with perforated small holes (4) near to an edge in an upper part of said planes, a string (5) being pulled through said small holes, to the effect that said container is kept either entirely collapsed or folded outwardly in a desired position by said string, which is put through said holes in said planes (2) and kept at a defined place through said holes, and said container being formed by folding the container into a vase and further comprising a flower or plant placed into the vase.

2. The packaging container according to claim 1, characterized in that the container is made of a structural cardboard impermeable by impregnation, coating or lining with a waterrepellent plastic.

3. The packaging container according to claim 2, characterized in that the cardboard is coated with a film of polypropylene.

4. The packaging container according to claim 2, characterized in that the cardboard is coated with polyethylene and aluminum foil.

5. A foldable packaging container for transport and display of flowers and plants, comprising a quadrangular sheet of a cardboard, where the cardboard is rendered waterproof or water-repellent by impregnation coating or lining it with a plastic liner;

wherein folding lines are prepunched on a surface of said coated cardboard, with said folding lines running diagonally, horizontally and vertically on said surface of the cardboard;

wherein by folding two center lines; running horizontally or, respectively, vertically, there are formed four side planes and one connecting square bottom surface;

wherein said side planes are connected to each other by a square, respectively, which square is folded inwardly along the diagonally running prepunched folding line and thereby forms folded flaps; and wherein a hollow quadrangular container is created by a forming of the side planes, the square bottom surface, and the folding flaps, and wherein said container is a vase containing a flower or plant.

6. The foldable packaging container according to claim 5, further comprising earth added into the quadragular container to keep the flowers or plants upright, where water can be added to the earth which adds moisture to the earth and which moisture keeps the flowers or plants fresh.

7. The foldable packaging container according to claim 5, further comprising moss added into the quadrangular container to keep the flowers or plants upright, where water can be added to the moss which adds moisture to the moss and which moisture keeps the flowers or plants fresh.

8. The foldable packaging container according to claim 5, wherein the plastic for the liner constituting the waterproof coating of the cardboard is made of a polymeric organic resin.

9. The foldable packaging container according to claim 5, wherein the coating is a film of polypropylene.

10. The foldable packaging container according to claim 5, wherein the coating consists of polyethylene and aluminum foil.

11. The foldable packaging container according to claim 5, wherein the height of the container depends on the height of the side planes.

12. The foldable packaging container according to claim 5, wherein side planes comprise an upper edge, where small holes are punched near the upper edge of the side planes and where a string is pulled through said small perforated holes, wherein said string will keep the container in a desired position depending on the degree of tightness of the string.

13. The foldable packaging container according to claim 12, wherein a heigher degree of tightness of the string will bring about a completely collapsed container and a lesser degree of tightness of the string will bring about an outwardly fanning container.

14. A method of manufacture of a packaging container for flowers and plants, characterized in cutting a waterproof cardboard sheet to quadrangular shape;

creasing the waterproof cardboard with folding lines in cross-form and diagonal over a surface, punching of the waterproof cardboard a pair of small holes in a middle of a side of the waterproof cardboard near to an edge, pulling a string of sufficient length through said holes and placing a flower or plant within the container.

15. A method for the manufacture of a foldable packaging container for flowers and plants comprising the following steps cutting out a flat square of waterproof cardboard having a surface;

prepunching folding lines in diagonal, horizontal and vertical direction on the surface of the cardboard, wherein the two center lines, running horizontally or, respectively, vertically, form four side planes with an upper edge and one connecting square bottom surface, punching two small holes in each side plane near the upper edge, threading a string of a required length through the small holes punched near the upper edges of the side planes and placing a flower or plant in the container.

* * * * *